US006840337B2

(12) United States Patent
Terry et al.

(10) Patent No.: US 6,840,337 B2
(45) Date of Patent: Jan. 11, 2005

(54) METHOD AND APPARATUS FOR REMOVING CUTTINGS

(75) Inventors: James B. Terry, Houston, TX (US); Carey J. Naquin, Katy, TX (US); Patrick Laursen, Sugar Land, TX (US); James Estep, Houston, TX (US); Martin Paulk, Houston, TX (US); E. Alan Coats, The Woodlands, TX (US); Ron Crook, Duncan, OK (US); Rickey L. Morgan, Comanche, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/229,964

(22) Filed: Aug. 28, 2002

(65) Prior Publication Data

US 2004/0040749 A1 Mar. 4, 2004

(51) Int. Cl.[7] ..... E21B 21/08

(52) U.S. Cl. ..... 175/38; 175/61; 175/76; 175/325.1; 175/391; 175/99; 175/62; 175/215; 166/312; 166/50; 138/108

(58) Field of Search ..... 175/320, 61, 73, 175/76, 325.1, 391, 92, 99, 62, 215, 38, 100; 166/242.2, 311, 312, 319, 50; 138/108, 133, 153, 174

(56) References Cited

U.S. PATENT DOCUMENTS

| | | | | |
|---|---|---|---|---|
| 4,484,641 A | | 11/1984 | Dismukes | 175/61 |
| 4,860,830 A | | 8/1989 | Jennings, Jr. et al. | 166/312 |
| 5,462,118 A | | 10/1995 | Jennings, Jr. et al. | 166/312 |
| 5,465,787 A | | 11/1995 | Roth | 166/66.4 |
| 5,975,144 A | | 11/1999 | Akedo et al. | 138/129 |
| 5,984,011 A | | 11/1999 | Misselbrook et al. | 166/312 |
| 5,988,702 A | | 11/1999 | Sas-Jaworsky | 285/249 |
| 6,176,323 B1 | * | 1/2001 | Weirich et al. | 175/40 |
| 6,213,226 B1 | | 4/2001 | Eppink et al. | 175/61 |
| 6,227,312 B1 | * | 5/2001 | Eppink et al. | 175/57 |
| 6,290,001 B1 | | 9/2001 | West et al. | 175/61 |
| 6,296,066 B1 | | 10/2001 | Terry et al. | 175/92 |
| 6,488,104 B1 | * | 12/2002 | Eppink et al. | 175/61 |
| 6,494,272 B1 | * | 12/2002 | Eppink et al. | 175/57 |

FOREIGN PATENT DOCUMENTS

| | | | |
|---|---|---|---|
| WO | WO 01/09478 A1 | 8/2001 | E21B/4/00 |

OTHER PUBLICATIONS

J. Li and S. Walker, "Sensitivity Analysis of Hole Cleaning Parameters in Directional Wells," SPE 54498, p. 307–316, May 1999.

S. Walker, J. Li, "The Effects of Particle Size, Fluid Rheology, and Pipe Eccentricity on Cuttings Transport," SPE 60755, Apr. 2000.

Rishi B. Adari, Stefan Miska and Ergun Kuru, "Selecting Drilling Fluid Properties and Flow Rates for Effective Hole Cleaning in High–Angle and Horizontal Wells," SPE 63050, Oct. 2000.

S. Walker and J. Li, "Coiled–Tubing Wiper Trip Hole Cleaning in Highly Deviated Wellbores," SPE 68435, Mar. 2001.

Slavomir S. Okrajni and J.J. Azar, "The Effects of Mud Rheology on Annular Hole Cleaning in Directional Wells," SPE 14178, Aug. 1986, pp. 297–308.

* cited by examiner

*Primary Examiner*—David Bagnell
(74) *Attorney, Agent, or Firm*—Conley Rose, P.C.

(57) ABSTRACT

An apparatus and method for removing cuttings in a deviated borehole using drilling fluids. The apparatus includes a pipe string and a bottom hole assembly having a down hole motor and bit for drilling the borehole. The pipe string has one end attached to the bottom hole assembly and does not rotate during drilling. The apparatus and methods raise at least a portion of the pipe string in the deviated borehole to remove cuttings from underneath the pipe string portion.

32 Claims, 11 Drawing Sheets

FIG 6A
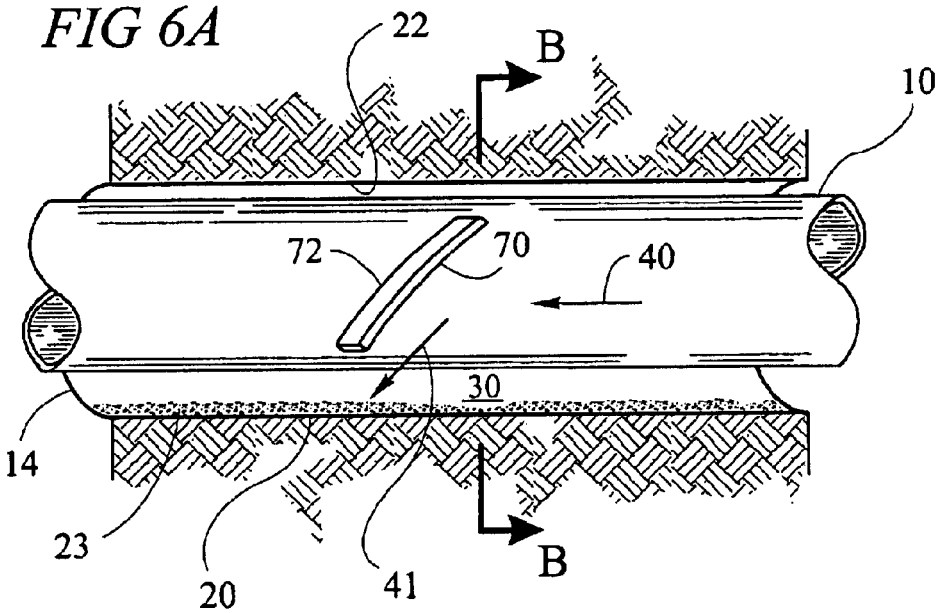
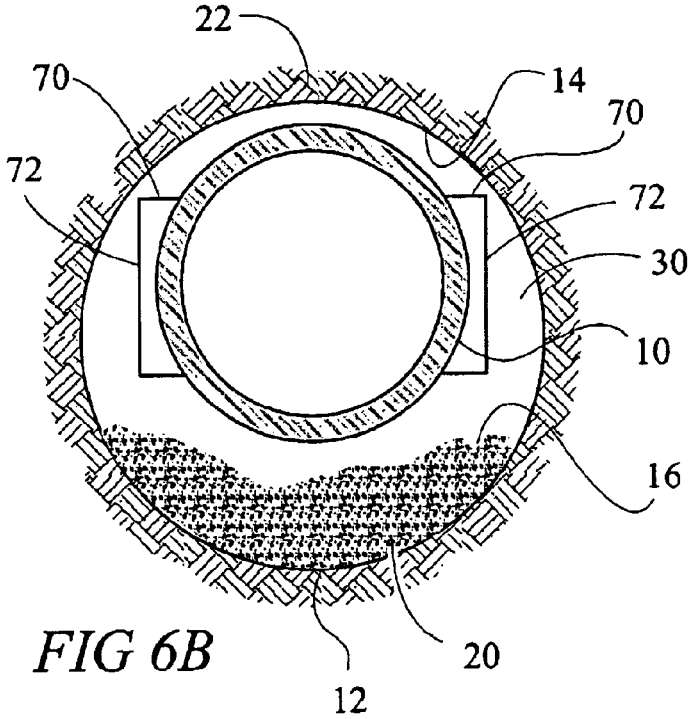
FIG 6B

FIG 7A
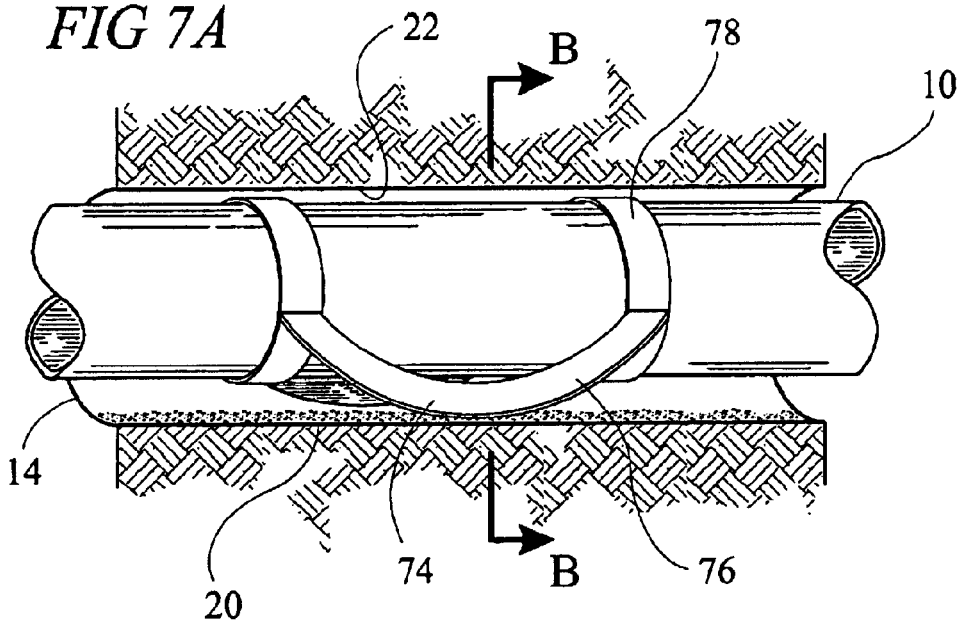
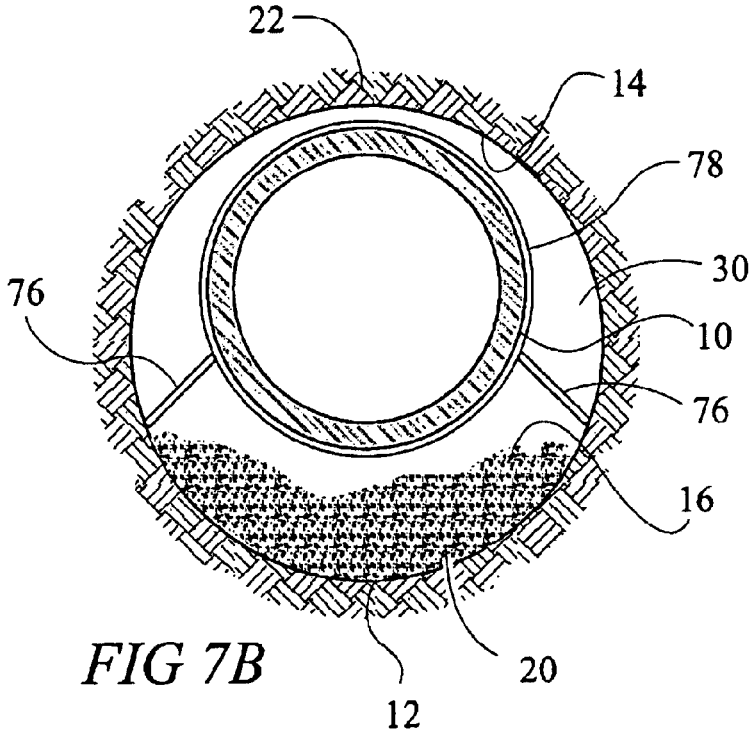
FIG 7B

METHOD AND APPARATUS FOR REMOVING CUTTINGS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to coiled tubing drilling systems. More particularly, the present invention relates to removing drilled cuttings from a well bore during coiled tubing drilling operations. In one embodiment, the invention relates to enhancing the coiled tubing so as to facilitate removal of "cuttings beds" in a "deviated" well bore.

2. Related Art

In the field of oil well drilling, coiled tubing (CT) is becoming an increasingly common replacement for traditional steel segmented pipe in order to meet the demands of drilling deviated and horizontal wells. Conventional drill strings consist of hundreds of straight steel tubing segments that are screwed together at the rig floor as the string is lowered down the well bore. With coiled tubing (CT), the drill string consists of one or more continuous lengths of CT that are spooled off one or more drums or spools and connected together for injection into the well bore from a rig as drilling progresses. Another major difference between conventional rotary drilling and CT drilling is the absence of drill pipe rotation. By using CT, much of the time, effort, and opportunity for error and injury are eliminated from the drilling process.

Coiled tubing, as currently deployed in the oilfield industry, generally includes small diameter cylindrical tubing made of metal or composites that have a relatively thin cross sectional thickness. CT is typically much more flexible and much lighter than conventional drill string. Thus, CT is particularly suited to drilling horizontal and other deviated wells where bending and flexing of the drill pipe is necessary. These characteristics of CT have led to its use in various well operations. CT is introduced into the oil or gas well bore through wellhead control equipment to perform various tasks during the exploration, drilling, completion, production, and workover of a well. For example, CT is routinely utilized to inject gas or other fluids into the well bore, inflate or activate bridges and packers, transport well logging tools downhole, perform remedial cementing and clean-out operations in the well bore, and to deliver drilling tools downhole.

FIG. 1 shows a simple illustration of how CT is utilized in an oil well drilling application. The CT drill string 10 is stored on a reel or drum 110. As the drill string 10 is spooled off the reel 110 and directed toward the rig 120, the tubing passes through a set of guide rollers 130 attached to a levelwind 140. The levelwind 140 is used to control the position of the CT as it is spooled off and onto the service reel 110. As the tubing approaches the rig 120, it contacts the gooseneck or guide arch 150. The tubing guide arch 150 provides support for the tubing and guides the tubing from the service reel through a bend radius prior to entering an injector 160 on the rig 120. The tubing guide arch 150 may incorporate a series of rollers that center the tubing as it travels over the guide arch and towards the injector 160. The injector 160 grips the outside of the tubing and controllably provides forces for tubing deployment into and retrieval out of the well bore. It should be noted that the rig 120 shown in FIG. 1 is a simple representation of a rig. Those skilled in the art will recognize that various components are absent from FIG. 1. For instance, a fully operational rig may include a series of valves or spools as would be found on a christmas tree or a wellhead. Such items have been omitted from FIG. 1 for clarity.

Early iterations of CT were metallic in structure, consisting for instance of carbon steel, corrosion resistant alloys, or titanium (MCT). These coiled tubes were fabricated by welding shorter lengths of tubing into a continuous string. More recent designs have incorporated composite materials. Composite coiled tubing (CCT) includes various materials, as for example: fiberglass, carbon fiber, and Polyvinylidene Fluoride (PVDF). The fiberglass and carbon fiber are in an epoxy or resin matrix and wrapped around a PVDF tube. These materials are generally desirable in CT applications because they are lighter and more flexible, and therefore less prone to fatigue stresses induced over repeated trips into the well or due to the heave of floating drilling vessel.

In removing drilled cuttings from any well, drilling fluids circulated in the well suspend the cuttings and carry them to the surface for removal from the well. Mud is typically pumped down through the inner flow bore of the drill string, out through the bit at the bottom of the borehole, and back up through the annulus formed between the drill string and borehole wall. In a vertical hole, the velocity vector counters the gravity vector. When the velocity vector opposes the gravity vector, the cuttings can be easily suspended and lifted in the vertical borehole. Thus, removal of drilled cuttings from a substantially vertical well presents little problems. However, in drilling deviated and horizontal wells, the velocity vector deviates from vertical and is sometimes horizontal, while the gravity vector remains vertical. In this situation, the cuttings tend to settle to the bottom of the hole away from the fluid flow. Such deposits are commonly called "cuttings beds." As used herein, the term "deviated" with respect to wells shall be understood to include any well at sufficient angle or deviation from vertical that cuttings beds tend to form during the drilling operation. "Deviated" wells shall be understood to include without limitation "angled," "high-angled," "oval," "eccentric," "directional" and "horizontal" wells, as those terms are commonly used in the oil and gas industry. A "highly deviated" well is defined as a well having an angle of 45° to 90° from vertical.

The cuttings beds problem is exacerbated when obstructions in the fluid path through the deviated borehole disrupt the fluid velocities, especially on the low side of the borehole. Due to the gravity force, the CT drill pipe tends to lie on the low side of the hole when drilling deviated well bores.

Referring to FIGS. 3A, B and C, the drill bit (not shown) forms cuttings as the bit drills into the formation causing the formation of cuttings beds 20 in deviated well drilling. In FIG. 3A, the non-rotating drill string 10 is shown resting against the bottom 12 of a horizontal or deviated borehole 14. The cuttings from the bit are shown settling underneath drill string 10 and in the arcuate areas on each side of the lower side of the drill string in area 16 as shown in FIG. 3B to form cuttings beds 20. In FIG. 3B, the returning drilling fluid tends to flow most vigorously through the larger upper arcuate area 18 of annulus 30 above drill string 10. Upper portion 18 is the path of least resistance for the fluid flow, thereby causing a minimal fluid flow around the bottom of drill string 10 adjacent the cuttings beds 20. This phenomenon is represented by the velocity profile of FIG. 3C. The slower fluid flowing around the bottom of drill string 10 is unable to keep the cuttings entrained, thus gravity causes them to settle out and gather in area 16 thereby forming cuttings beds 20. The cuttings then tend to accumulate and bury drill string 10.

Buildup of cuttings beds can lead to stuck pipe, reduced weight on the bit leading to reduced rate of penetration, undesirable friction, restricted movement, transient hole blockage leading to lost circulation conditions, excessive drill pipe wear, extra cost for special mud additives and wasted time by wiper trip maneuvers. Cuttings also reduce the interval of wells that can be drilled with CT. Cuttings beds are especially problematic in extended reach drilling and in wells using invert emulsion type drilling fluids.

Cleaning (i.e., removing drilled cuttings from) a deviated well, particularly drilled at a high angle, can be difficult. One of the critically limiting factors in drilling with CT is the inability to clean the hole in deviated wells. This inability is caused largely by the small diameter tubing and tools usually associated with CT and CT bottom hole assemblies. The small diameter restricts the drilling fluid volume and velocity which can be achieved through the tubing and tools, thus reducing the annular volume and velocity of the drilling fluid that can be used to transport the cuttings from the borehole. Further, in CT drilling, the CT does not rotate so there is little mechanical action to stir the cuttings off of the low side of the borehole. Other factors contributing to inadequate hole cleaning include limited pump rate, drill pipe eccentricity (positioning of the CT in the well bore; low side=+100% eccentricity, high side=−100% eccentricity), sharp build rates, high bottom hole temperatures, and oval shaped well bores. In turn, inadequate hole cleaning can lead to cuttings beds buildup in the wellbore.

Various methods have been tried to remove cuttings which usually settle on the low side of a deviated borehole. One method, marginally successful at best, is to vary the drilling fluid/medium properties, regimes, and rates. Well treatments or circulation of fluids specially formulated to remove cuttings beds are sometimes used to prevent buildup to the degree that they interfere with the drilling apparatus or otherwise with the drilling operation. Two commonly used types of fluids that have been applied with limited success are highly viscous fluids, having greater viscosity or density than the drilling fluids being used in the drilling operation, and lower viscosity fluids, having less viscosity or density than the drilling fluids being used in the drilling operation. Commonly, the drilling operation must be stopped while such fluids are swept through the wellbore to remove the cuttings.

Alternatively, or additionally, special viscosifier drilling fluid additives have been proposed to enhance the ability of the drilling fluid to transport cuttings. In one embodiment, the viscosifier is introduced into the drilling fluid by a pill. However, such additives at best merely delay the buildup of cutting beds and can be problematic if they change the density of the drilling fluid.

More specifically, this method includes high density and low density sweeps. In other words, a volume of high density drilling mud is pumped down the drill string flowbore followed by a volume of low density drilling mud. For example, the drilling system may be using 9 pound drilling mud. Then, a 2 or 3 barrel kill of a heavy weight mud may be pumped down the flowbore. Once the slug of heavy weight mud passes through the flowbore and bit, it enters the annulus where the surrounding drilling fluid is much lighter. As gravity acts on the different density fluids, a distinct disparity is created in the annulus with the heavy weight mud moving toward the bottom of the borehole. This causes the velocity profile of FIG. 3C to shift downward such that more of the fluids toward the bottom of drill string 10 are moving faster. Consequently, some of cuttings 20 are re-suspended in the fluid flow and carried to the surface. However, the velocity profile may not be shifted enough to carry away a significant portion of the cuttings, whereby most of the cuttings are still trapped underneath drill string 10. It should be noted that this prior art method is directed to shifting the velocity profile in the deviated borehole.

An ancillary procedure to fluid additives includes the use of foam to clean the borehole. Large volumes of gas are injected into the mud causing the drilling fluid to have bubbles, which then serve to clean the borehole. The gas flux creates an in situ foam for cleaning the hole. This may create under balance drilling. The use of foam to clean the borehole is in the prior art. However, foam sweeps and gas influx could be used in combination with other prior art embodiments, as well as embodiments and solutions of the present invention.

Mechanical means have also been employed to remove cuttings beds from the bottom of a deviated borehole. One of the simplest is rotating the drill pipe. Rotating the drill pipe agitates cuttings gathering at the bottom of a deviated well bore. The cuttings are lifted from the bottom, suspended in the moving drilling fluid, and carried to the surface. However, CCT and MCT are typically not rotated in the borehole. Thus, the CT tends to settle on the bottom of the borehole, allowing drilled cuttings to accumulate at the bottom of the borehole where the fluid velocity and volume is minimal. It should be understood that the present invention particularly applies to non-rotating drill pipe.

It has been proposed that composite pipe be made in sections and connected by joints such that the jointed composite drill pipe can be rotated while drilling a well. See, for example, International Publication W 01/09478A1 published Feb. 8, 2001. Studies have been made for rotating jointed composite pipe in a drilling system. However, the effectiveness of jointed composite pipe is unproven. Furthermore, as noted above, the focus of the present application is on non-rotating drill pipe without regard to the material that the pipe is made of. Thus, it is irrelevant whether the drill pipe is jointed or coiled tubing; application of the present invention depends on whether the drill pipe is rotated or not.

Another mechanical operation for removing cuttings beds has also been used wherein the drill string is pulled back along the well, pulling the bit through the horizontal or deviated section of the well. Dragging the bit back up the borehole stirs up cuttings in the cuttings beds to better enable the drilling fluid to transport the cuttings up the well. The bit is typically pulled back to the location where the borehole is no longer highly deviated. However, such dragging of the bit can damage its gage side, and dragging the bit while rotating, further reams the hole. Also, such "wiper trips" are time consuming which increases drilling costs for the well and delays the ultimate completion of the well.

Another prior art mechanical device is a hydraulic oscillator which acts as a vibrator on the end of the drill string. The hydraulic oscillator shakes the drill string to loosen cuttings that have been packed together underneath and adjacent to that portion of the drill string positioned on the bottom of the deviated borehole. However, it has been found that the vibrator works only on the cuttings beds that are in close proximity to the vibrator, and not beds that extend continuously up the entire length of the tubing string present in the deviated portion of the wellbore. Generally, the vibrations are only effective up to 15 or 20 feet on either side of the hydraulic oscillator.

An alternative mechanical operation for removing cuttings beds has been proposed that employs drilling with CT and injecting fluid into the wellbore through the tubing at a flow rate exceeding the flow rate range used for drilling, as discussed in U.S. Pat. No. 5,984,011 ('011 patent), entitled Method for Removal of Cuttings from a Deviated Wellbore Drilled with Coiled Tubing. However, this operation calls for special equipment and requires that drilling be stopped during the treatment, resulting in delays and increased drilling costs.

More specifically, the '011 patent discloses a valve placed above the bit to increase the fluid flow rate up the annulus. The method taught by the '011 patent involves placing a nozzle with a valve at the upper end of the bottom hole assembly, halting drilling operations, and opening the valve. The flow rate of drilling fluid passing through the nozzle is increased, which washes away any cuttings that had collected around the drill string. This is called by-pass circulation, and the device used to create by-pass circulation is generally called a circulation sub. The '011 patent teaches a particular range of return fluid flow rates up the annulus to remove the cuttings.

The drilling system that is the subject of U.S. Pat. No. 6,296,066 ('066 patent), entitled Well System, also discloses a circulation sub. Nozzles are disposed at the connection of the CCT to the upper end of the bottom hole assembly to provide direct flow into the annulus.

However, neither of the previous circulation sub methods works satisfactorily. By-pass circulation works to properly agitate cuttings beds if the nozzle is sized to create flow rates that place the fluid around the drill pipe into turbulent flow. Turbulent flow lifts the cuttings off the bottom of the borehole. Unfortunately, turbulent flow only occurs at a location very close to the circulation sub. Thus, the circulation sub is only able to stir up cuttings close to the sub. This is the same problem presented by the hydraulic oscillator described hereinabove.

If the port is large enough and the flow rate through the nozzle is significant enough, then the fluid along the length of the drill string could be placed into turbulent flow. Achieving turbulent flow along at least a substantial portion of the drill string present in the deviated portion of the wellbore would produce sufficient cuttings removal. However, such ports create fluid flow volumes and rates that tend to erode the borehole wall. A large port opening combined with greater fluid velocities creates a fluid pressure able to achieve high turbulence. Unfortunately, the fluid at high velocities impinges on the surrounding formation, thereby causing erosion.

Even assuming borehole erosion was not a problem, not enough drilling fluid can flow through the CT to provide sufficient fluid pressure through an enlarged port. There is a finite diameter of the internal bore of the CT. The volume of fluid required to get turbulence in the annulus is extremely high so that the back pressure along the tube exceeds the burst pressure of the tube. In other words, the CT cannot withstand the pressure required to pump enough fluid through this small diameter bore to achieve turbulent flow in the annulus using CT. The '011 patent teaches stopping drilling and diverting all flow through the port, but even this does not achieve turbulence in the annulus using CT. The '011 patent discloses an increase in the fluid flow rate, but that increase does not achieve turbulence.

The '011 patent also teaches forming the CT into a helix, thereby reducing the contact of the drill pipe along the bottom of the hole. This method requires pushing down on the CT from the surface. This may be done using the injector head on the rig 120. As illustrated in FIG. 10B, the force exerted on drill pipe 10 causes it to buckle and coil up in the borehole. However, most of the helix formed by the CT is not located at the bottom of the borehole using this method but above the deviated borehole. Ideally, the helix only touches the bottom of the borehole at certain points along the helix, thereby increasing the fluid flow around and removal rate of cuttings 20. However, there are various problems with this method. For example, when force is applied to the top of the CT, resistance is greatest at the top of the borehole. This causes the helical lock up to occur high in the borehole rather than at the lower end of the borehole, where the highly deviated portion of the well bore and bit are located.

None of the above mentioned devices or methods have provided adequate results for properly cleaning cuttings from a deviated wellbore. The present invention overcomes deficiencies of the prior art.

BRIEF SUMMARY OF PREFERRED EMBODIMENTS OF THE INVENTION

The apparatus and methods of the present invention include removing the cuttings from a deviated borehole using drilling fluids. The apparatus includes a pipe string, a bottom hole assembly having a down hole motor and bit for drilling the borehole. The pipe string has one end attached to the bottom hole assembly and does not-rotate during drilling. Various apparatus and methods are disclosed for raising at least a portion of the pipe string in the deviated borehole to remove cuttings from underneath the pipe string portion.

The present invention seeks to locate the coiled tubing drill pipe in a deviated wellbore where optimal drilled cuttings removal is achieved. Studies indicate that the preferred location for the drill pipe in a deviated borehole is off the bottom of the borehole to allow fluid flow underneath the drill string to remove the cuttings. More particularly, the studies show that the optimal location for the drill sting is near the top of the borehole. Therefore, the present invention is directed to locating the coiled tubing drill pipe in the upper portion of a deviated borehole. Although it may be preferred to maintain the drill pipe in the upper portion of the borehole, it may not be necessary that the drill pipe be continuously maintained in the upper portion of the borehole. It only needs to be maintained in the upper portion of the borehole long enough to clean out the cuttings which are accumulated around the bottom of the borehole.

The drilled cuttings typically settle out of the drilling fluid to the low side of the borehole. As the drilling fluid/medium is circulated in the annulus of the borehole, the fluid/medium velocities in that portion of the borehole where the drilled cuttings have settled out are lower than they are in the unrestricted high side of the borehole as the fluid/medium takes the path of least resistance. In the present invention, the drill pipe is raised off the low side of the borehole thus increasing the fluid/medium velocities and flow in the area of the borehole where the cuttings have settled out. Increasing the velocities in this part of the borehole improve the ability to agitate and carry the cuttings back to the surface with the flowing fluid/medium.

In a first embodiment, the present invention takes advantage of the variable properties of composite coiled tubing (CCT). The CCT can be manufactured with different materials such that the CCT is less dense and capable of floating in the drilling fluid.

In another embodiment, the outer diameter and wall thickness of the CCT are increased. This also may serve to make the CCT more buoyant and capable of floating in the drilling fluid, while also increasing the annular velocity of the drilling fluids surrounding the CCT for the same sized borehole.

In a further embodiment, both the materials and dimensions of the CCT are varied to achieve the desired density and thus buoyancy within the drilling fluid.

Other objects and advantages of the invention will appear from the following description.

BRIEF DESCRIPTION OF THE DRAWINGS

For a detailed description of a preferred embodiment of the invention, reference will now be made to the accompanying drawings wherein:

FIG. 6A is a side elevational view, partly in cross section, of a drill string with fluid deflectors for raising the drill pipe off the bottom of a deviated borehole;

FIG. 6B is a cross section at plane B—B in FIG. 6A;

FIG. 7A is a side elevational view, partly in cross section, of a drill string with mechanical deflectors for raising the drill pipe off the bottom of a deviated borehole;

FIG. 7B is a cross section at plane B—B in FIG. 7A;

NOTATION AND NOMENCLATURE

Figure 1:
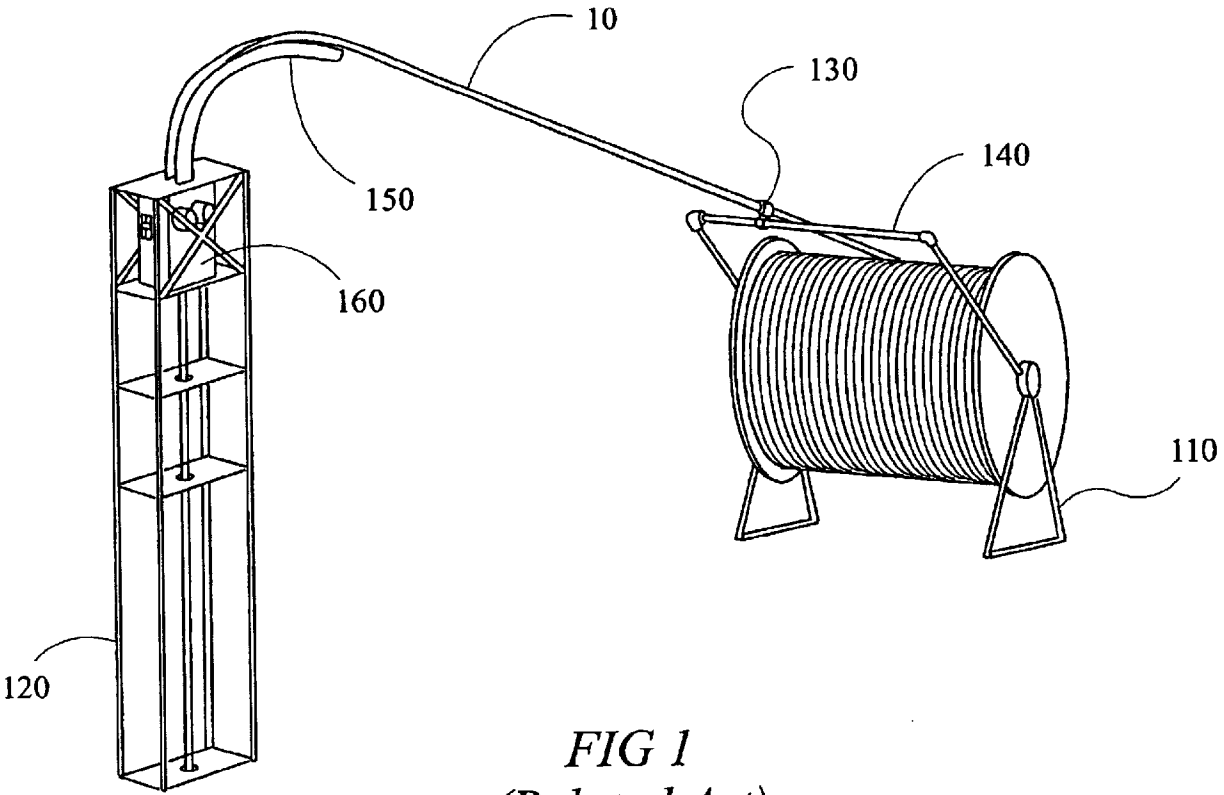
FIG 1 (Related Art)
FIG. 1 is a schematic showing the installation of coiled tubing in a well.

Certain terms are used throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . ".

The present invention relates to locating a coiled tubing drill pipe in the upper portion of a deviated well bore. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

In particular, various embodiments of the present invention provide a number of different constructions and methods of operation. It is to be fully recognized that the different teachings of the embodiments discussed below may be employed separately or in any suitable combination to produce desired results. Reference to up or down will be made for purposes of description with "up" or "upper" meaning toward the uppermost point of the well via the physical wellbore and "down" or "lower" meaning toward the bottom of the primary wellbore or lateral borehole via the physical wellbore or borehole. "Deviated" wells shall be understood to include without limitation "angled," "high-angled," "oval," "eccentric," "directional" and "horizontal" wells, as those terms are commonly used in the oil and gas industry. A "highly deviated" well is defined as a well having an angle of 45° to 90° from vertical.

DETAILED DESCRIPTION OF THE PREFERRED EMBODIMENTS

Figure 2:
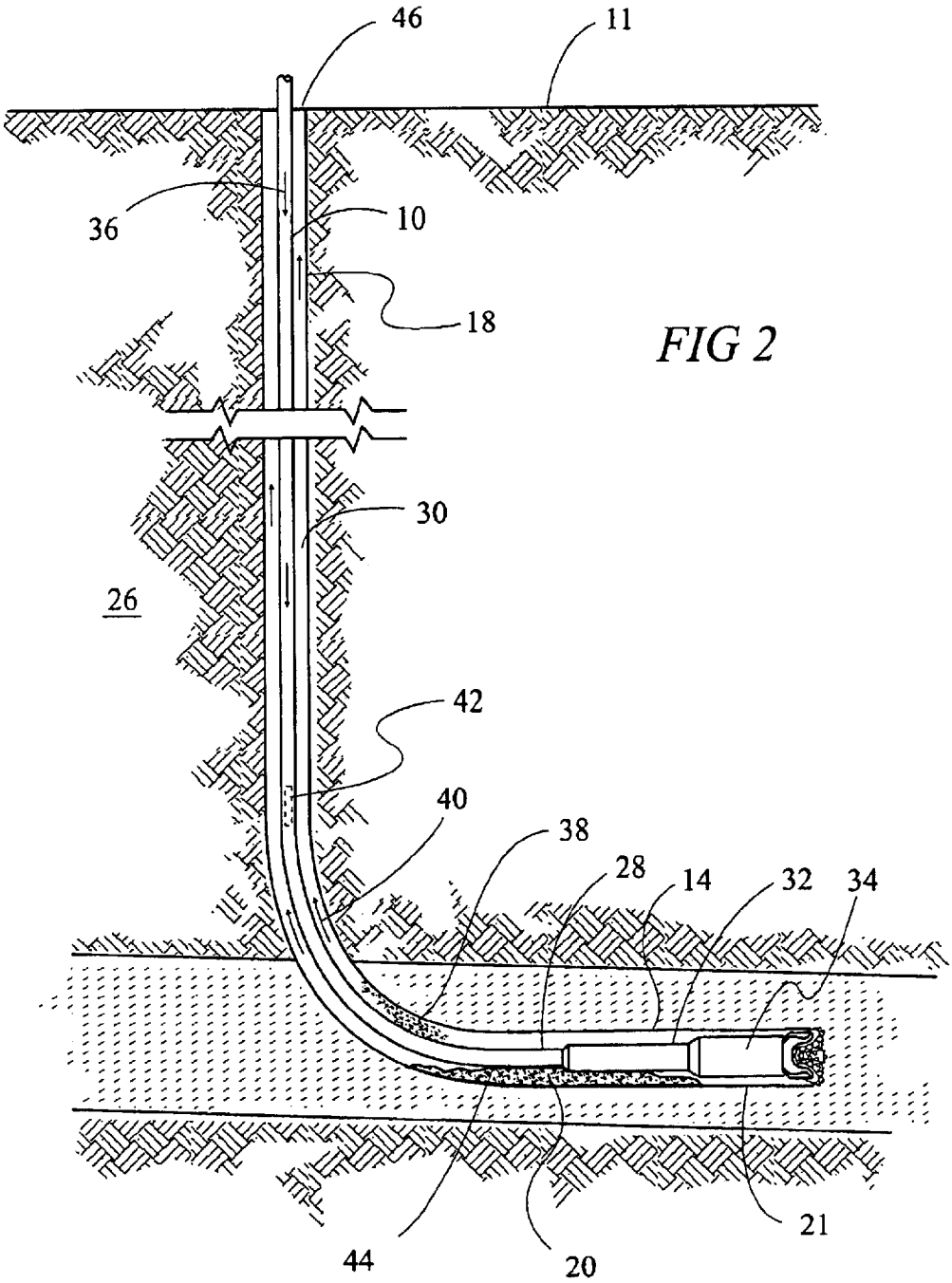
FIG. 2 is a schematic elevational view of an example well having cuttings beds to be removed.

Referring initially to FIG. 2, the CT drill string 10 is shown extending from the surface 11 down through the vertical wellbore portion 18 with the drill string 10 beginning to bend at transition section 42 and extending further down into the deviated wellbore portion 14 which extends through the formation 26. By way of example, the deviated wellbore portion 14 is shown becoming substantially horizontal. However, it should be understood the deviated wellbore portion 14 can be any deviated wellbore as that term is defined hereinabove. The lower terminal end 21 of the drill string 10 is connected to a downhole motor 32 rotatably powering a drill bit 34 for drilling the borehole.

As the drill bit 34 cuts through the formation 26, it produces cuttings 38 which are carried away by the drilling fluid flowing up through the annulus 30, formed between the CT drill string and borehole wall, in the direction shown by arrow 40. The returning drilling fluid exits the top of the wellbore 46 at the surface 11. The suspended cuttings 38 are then filtered out of the drilling fluid before the drilling fluid is returned back down the flowbore of the drill string 10 as represented by arrow 36.

Figure 3A:
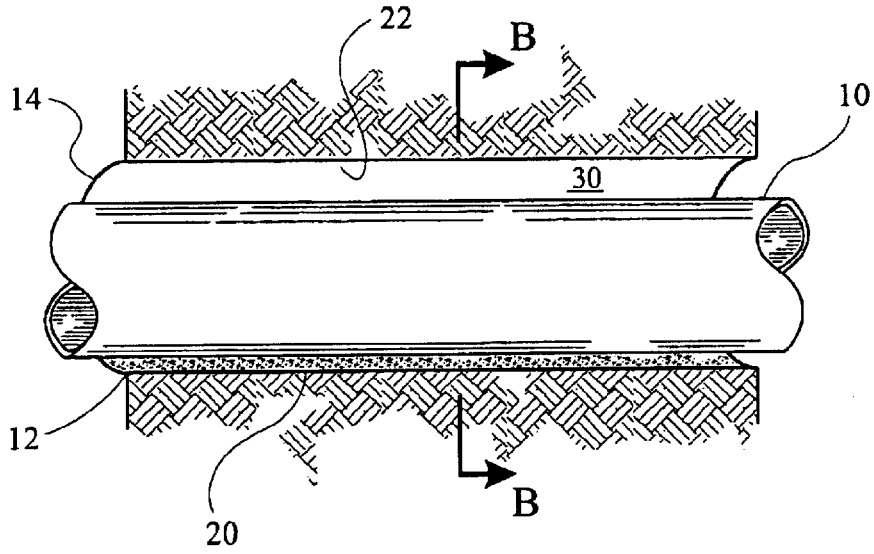
FIG. 3A is a side elevational view, partly in cross section, of a drill string laying on the bottom of a deviated borehole.

Referring now to FIGS. 3A, B and C, a portion of the cuttings 38 will tend to settle out of the drilling fluid and accumulate in the wellbore 46 to form cuttings beds 20. This is particularly a problem in the deviated wellbore portion 14, where the cuttings 38 accumulate on the bottom of the deviated wellbore 14 around that portion of the drill string 10 which lays on the bottom surface 44 of wellbore 46. As mentioned before, the accumulated cuttings 38 form cuttings beds 20 which can cause undesirable friction with the drill string 10, can restrict movement of the drill string 10, and can cause differential sticking of the drill string 10.

As noted before, studies have shown that disposing the drill pipe off the bottom and nearer the top of a deviated well bore dramatically increases the cuttings removal rate. These studies reflect the fact that raising the drill pipe in the deviated well bore exposes the accumulated cuttings to a higher fluid velocity, as shown by the velocity profile of FIG. 4C.

Figure 3C:
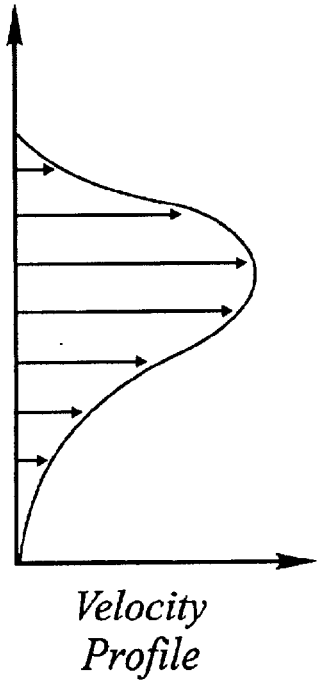
FIG. 3C is a velocity profile for flow through the annulus shown in FIGS. 3A and 3B.
Figure 3B:
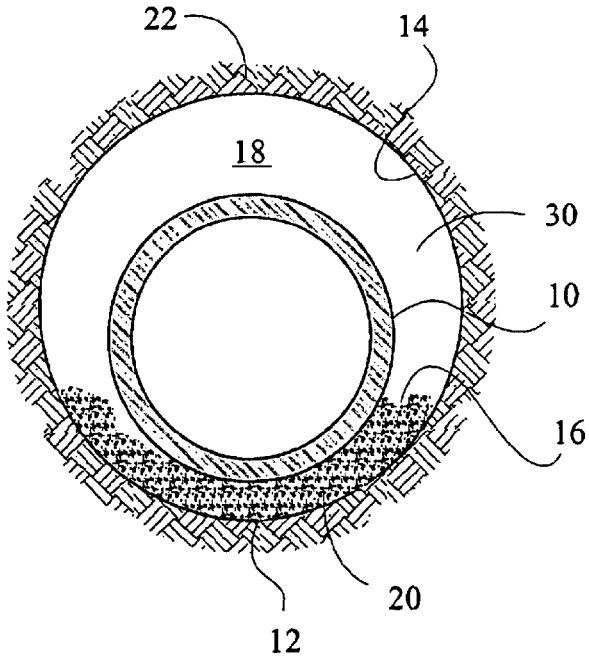
FIG. 3B is a cross section at plane A—A in FIG. 3A.
Figure 4A:
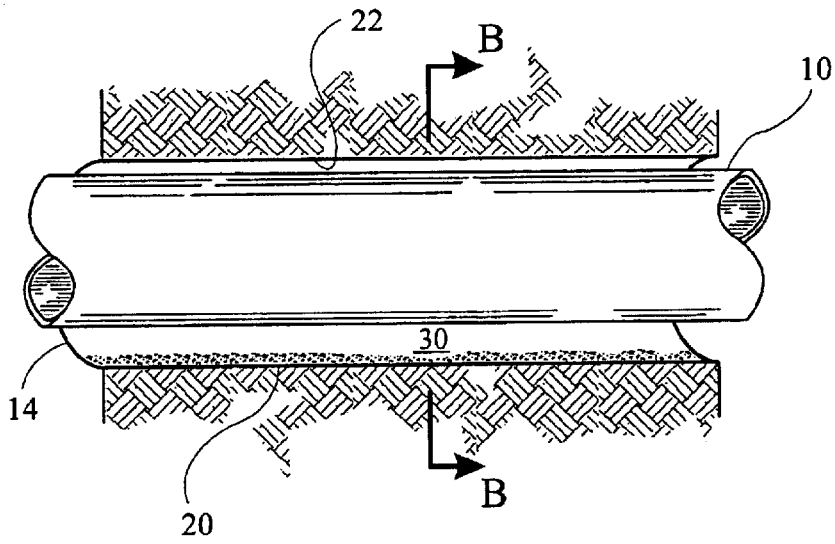
FIG. 4A is a side elevational view, partly in cross section, of a drill string positioned at the top of a deviated borehole.
Figure 4C:
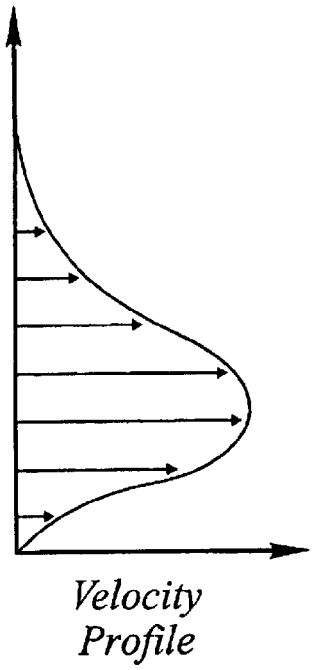
FIG. 4C is a velocity profile for flow through the annulus shown in FIGS. 4A and 4B.

Referring now to FIGS. 4A, B and C, drill pipe 10 is located at or near the top 22 of borehole 14, thereby exposing the cuttings beds 20 to the fluid flow in annulus 30. The velocity profile of FIG. 4C shows that the cuttings will be exposed to a much higher fluid velocity than the cuttings in FIG. 3C. With the higher fluid velocities below the drill string next to the cuttings, the removal rate is increased dramatically. Thus, it is preferred that the drill string be in contact with the top of the borehole, or as high in the borehole as possible.

One such study was performed by Halliburton Energy Services, Inc., Reference No. HTZPBF0691-067-02, entitled "Cementing Methods and Materials", hereby incorporated herein by reference. Each test was conducted with a 36 foot long, 5-½ inch casing model (representing the borehole) having a 4.85 inch inside diameter. A portion of a 3.125 inch tubing string was fixed at either the top or bottom end of the model. The model was fixed at 62° from vertical. All tests were performed with the same amount of drilling fluid at the same temperature and back pressure. Also, the same type and amount of drilled cuttings were used.

When the tubing string was placed at the bottom of the casing model and a 10.1 lb/gal drilling mud was pumped through the casing at 90 gal/min, only 11% of the cuttings were removed. When the tubing string was placed at the top of the casing model and the same test was run, 98% of the cuttings were removed. Again, the tubing string was placed at the bottom, although this time a 9.9 lb/gal drilling mud was pumped through the casing at 140 gal/min. This test achieved a 43% removal rate. However, when the tubing string was placed at the top of the casing model, a 95% removal rate was achieved.

Although it is to be understood that the different embodiments of the present invention are directed to the use of composite coiled tubing (CCT), many of them may be used with metal coiled tubing (MCT), as hereinafter described in further detail. It should also be understood that the drill string of the different embodiments may comprise sections of drill string having differing properties, such that only the section of CT that is disposed within the deviated portion of the wellbore is buoyant enough to float.

Without limitation, the preferred embodiments of the apparatus and method for removing cuttings cause the CT to float in the drilling fluid: (1) by varying the material composition and/or dimensions of the CT and/or (2) by varying the sweeps, i.e., the density of the drilling fluid flowing through the flowbore and through the annulus. Preferably, the CT floats continuously in the drilling fluid in the borehole, although causing the CT to float intermittently will also achieve cuttings removal.

One of the preferred embodiments includes varying the composition of the pipe to make the CT float in the drilling fluids. CT can be engineered to be buoyant in the drilling fluids flowing up the annulus of the borehole. Preferably, and in one embodiment of the present invention, the same dimensions as a non-buoyant pipe are maintained while changing the material composition so that the CT is less dense. Therefore, the CT will float in the denser drilling fluid while maintaining the current dimensions of the non-buoyant CT. While this embodiment is applicable to MCT, it is preferable to use CCT in this embodiment because of its increased property variability.

Each well has its own characteristics. Thus, different weight drilling fluids are used depending on the characteristics of the particular borehole being drilled. Consequently, the CT is engineered so that it floats in a particular density drilling fluid. See U.S. Pat. Nos. 5,988,702 and 6,296,066, hereby incorporated herein by reference. The preference is to design a composite pipe which floats in the lowest mud weight density ranges expected to be used in typical wells. Thus, CT that floats in 10 pound per gallon drilling fluid, or possibly 10.5, covers most drilling applications. If a heavier weight mud is used, the CT would be even more buoyant. Therefore, the objective is a CT that floats in the lowest projected density drilling fluid to be used.

Another embodiment consists of using the same material composition of the CT but increasing the outer dimensions and wall thickness of the pipe. This embodiment will be more difficult to achieve with metal coiled tubing because increasing the wall thickness of the drill pipe also increases the weight. However, with CCT, the pipe may be made thicker by loosening up the weave of the carbon fibers wrapped around the liner in the pipe. Alternatively, the carbon fiber layer can remain the same while a less dense layer is thickened. Furthermore, a less dense layer can simply be added to increase the outer dimensions and wall thickness of the pipe. Any of these solutions may be used separately or in combination. Thus, according to Archimedes Law, the pipe is now less dense and more buoyant in the drilling fluid because it displaces a greater volume of fluid while maintaining the same, or substantially similar, weight. Thus, with respect to these initial embodiments, the objective is to make the pipe lighter either by changing the material composition or by varying the dimensions of the pipe. In both instances, the density of the pipe is changed, i.e. made less dense, so that the pipe will float in the drilling fluids.

Still another embodiment is a combination of the previous two embodiments. This embodiment consists of varying both the material and the dimensions of the pipe to achieve the desired density and thus buoyancy within the drilling fluid. This approach allows more buoyancy to be achieved with MCT because the material composition of the MCT can be adjusted to compensate for any increase in the weight by way of increasing the outside diameter of the drill pipe.

A further embodiment consists of affixing multiple circumferential flotation collars of a discrete, handleable length to that portion of the drill string which is disposed in the deviated borehole. The collars are preferred to be of a discrete, handleable length so that they may be easily and readily attached to the pipe string by the operator. These flotation collars have a sufficiently low density-to-volume ratio so that the pipe floats in the designated drilling fluid for drilling a particular well. See U.S. Pat. No. 4,848,641, hereby incorporated herein by reference, disclosing buoyancy material on pipe.

Figure 5:
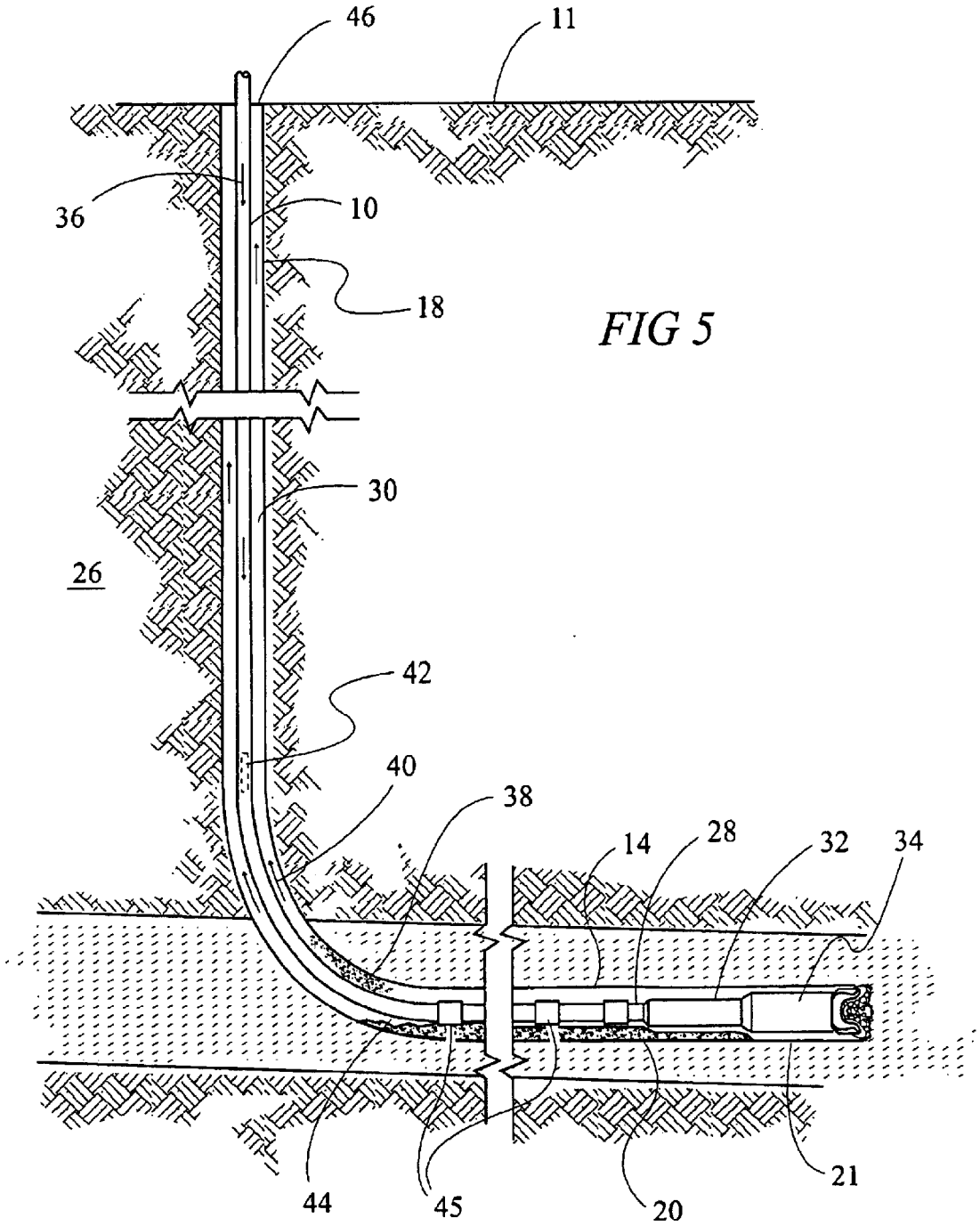
FIG. 5 is a side elevational view, partly in cross section, of a drill string with flotation sleeves for raising the drill pipe off the bottom of a deviated borehole.

Referring now to FIG. 5, flotation sleeves 45 are attached along the lower length of CT string 10. The flotation sleeves 45 may be a sleeving of only that portion of the drill string disposed in the deviated borehole. As the coiled tubing 10 is tripped into the hole, flotation sleeves 45 are disposed around pre-determined lengths of the drill pipe 10 so that it will float when disposed in the deviated portion of the borehole. The sleeves 45 may be snapped around the drill pipe 10. The sleeves are removed upon removing the CT string 10 from the well. The material and dimensions of the flotation sleeves 45 is determined by the flotation required to float the pipe in a particular weight of drilling mud and well fluids in the well. It is a function of drilling mud density, hole diameter, and other down hole parameters such as any well fluids in the well. In the prior art, there are buoyancy collars for attachment to risers.

Referring now to FIGS. 6A and 6B, a still further embodiment includes affixing deflectors 70 at spaced intervals along the CT string 10. As the fluid medium 40 flows by the deflectors in the annulus 30, the CT string 10 is forced upward to the high side 22 of the borehole 14. In one embodiment, the deflectors are mechanical devices with angled blades 72. Instead of floating the CT string 10 in the borehole 14, the deflectors 70 redirect the velocity vector of the fluid flow 40 radially downward such as at 41 toward bottom side 23 of the borehole 14. The resulting force on the drill pipe 10 will cause the CT string 10 to rise away from the bottom side 23 of the borehole 14.

Figure 8A:
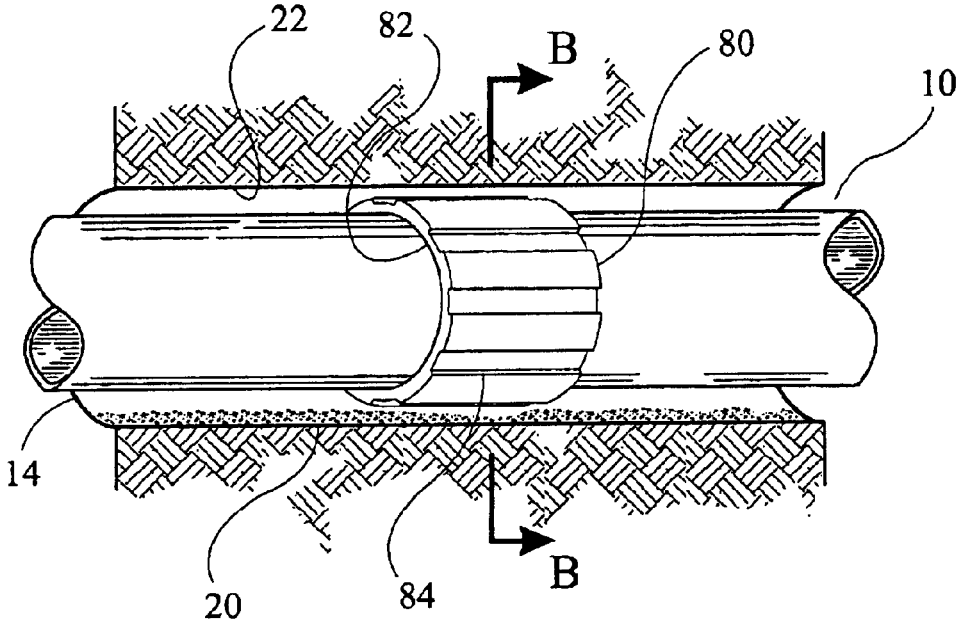
FIG. 8A is a side elevational view, partly in cross section, of a drill string with centralizers for raising the drill pipe off the bottom of a deviated borehole.
Figure 8B:
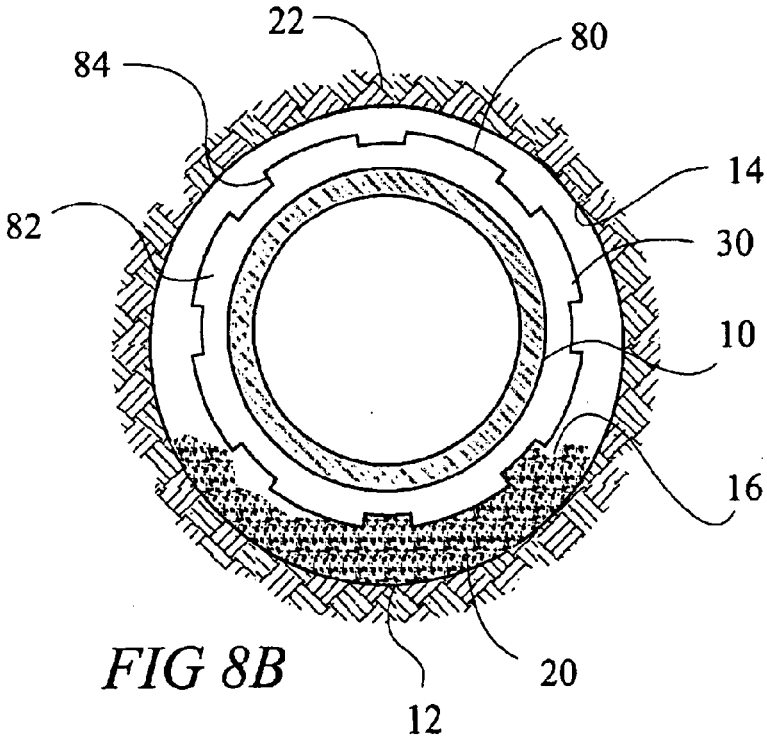
FIG. 8B is a cross section at plane B—B in FIG. 8A.

Referring now to FIGS. 7A and 7B, there is shown another embodiment of the deflector embodiment. The deflectors 74 are mechanical devices which cause the pipe to be maintained on the high side 22 of the borehole 14. In this embodiment, the deflectors 74 may be centralizers 76 having bow springs strapped to the string 10 at 78. The centralizers 76 engage the borehole wall and maintain the drill pipe 10 on the high side 22 of the borehole 14. Referring now to FIGS. 8A and 8B, instead of a centralizer having bow springs, the deflectors 80 may be thick centralizers 82. The thick centralizer 82 may not move the pipe to the high side 22 of the hole 14, but would tend to centralize the drill pipe 10 in the borehole 14 at least causing the drill pipe 10 to be off the bottom 23 of the borehole 14 so as to allow fluid flow to entrain and carry away the cuttings beds 20. The thick centralizer 82 is slotted or fluted at 84 to allow flow past the centralizer 82. The thick centralizer 82 may have straight or spiral blades. The deflectors 80 may also be eccentric stabilizers. See for example U.S. Pat. No. 6,213,226, hereby incorporated herein by reference. The eccentric stabilizer then orients the drill pipe 10 to the high side 22 of the borehole 14.

The deflectors do not necessarily add weight to the drill string 10. The deflectors may be made of material that also provides buoyancy to the drill pipe 10. For example, the deflectors may be made out of the composite material having the same density as the composite material in the CCT.

In still another embodiment of the present invention, the density or other properties of the fluid medium are varied such that the fluid inside the flowbore of the CT is lighter than the fluid in the annulus 30. A lighter fluid inside the CT as compared to the fluid in the annulus causes the CT drill pipe 10 to float and raise off the low side 23 of the borehole 14. One example of this concept includes alternating heavy and light slugs of drilling fluid passing through the flowbore and annulus. A finite volume or slug of heavy drilling fluid passes down the flowbore followed by a finite volume of lighter density drilling fluid. Once the heavy slug has passed through the flowbore and has entered the bottom portion of the annulus, the following lighter volume of drilling fluid fills the flowbore. At this point, the light fluid in the flowbore and the heavy fluid in the annulus create a density differential causing the CT drill pipe to raise off the bottom of the borehole, thereby allowing the cuttings beds 20 on the bottom 23 of the borehole 14 to be removed. Preferably, the slugs of heavy density drilling fluids are significant enough to create a sufficient density differential to lift the drill pipe 10. Longer stretches of deviated wellbore means larger lengths of drill pipe are in contact with the bottom side 23 of the borehole 14. As such, heavy slugs must be administered accordingly, ensuring that the heavy slugs extend through large enough portions of the borehole 14 to create the necessary density differential.

Potential problems exist with the heavy slug concept. If heavy weight drilling mud is used throughout the flowbore and annulus, the corresponding hydraulic head at the bottom 21 of the well could become too heavy, thereby negatively affecting drilling fluid circulation and possibly fracturing the well. Thus, the head is adjusted by using the lighter density drilling fluid in the flowbore. The average between the low density fluid in the flowbore and the high density fluid in the annulus 30 provides an average density such that the overall hydrostatic head is acceptable. Preferably, the average head in the fluid column is equivalent to the head provided by the typical drilling fluid for that well, which may be a weight in between the light drilling fluid and heavy drilling fluid. Preferably, the heavy slugs equal the light slugs of drilling fluid such that the average of the two weights equal the proper mud weight for that well. Thus, heavy and light drilling fluids can be used so long as they are weighted to avoid excessively heavy heads or fracturing the well.

The required range of densities of the drilling mud depends upon the pore pressure and fracture pressure of the well. The drilling mud in the borehole creates a hydrostatic pressure which places a head on the well. The pressure cannot be greater than the fracture pressure or the drilling fluids will flow into the formation. Likewise, the head cannot be less than the pore pressure, otherwise there is insufficient head to control down hole pressures to avoid an influx of well fluids and maybe a blowout. Thus, the weight of the drilling fluids used must be chosen carefully for the purpose of removing cuttings beds. Typically there is a fairly narrow range of mud weights which can be used in drilling a well particularly in deep wells drilled in deep water.

Changing the density of the drilling fluids to remove cuttings is taught by the prior art. However, in the present invention, the purpose of changing the densities is to float the pipe and not to cause the heavier drilling fluid to remove the cuttings on the bottom of the bore. In the prior art, the change in the density of the drilling fluid is merely to shift the velocity profile from something, such as shown in FIG. 3C, to something closer to that shown in FIG. 4C.

Figure 9:
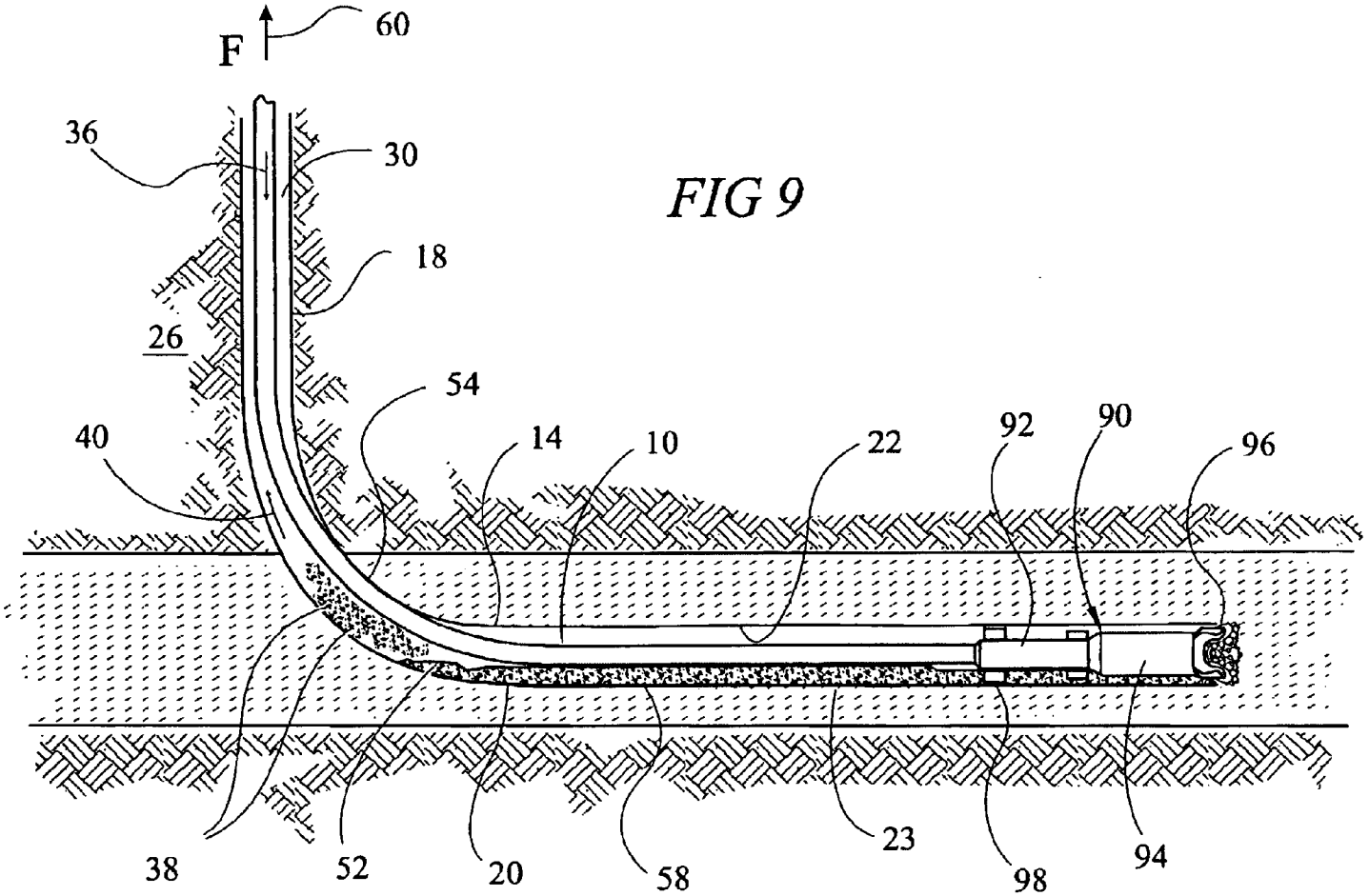
FIG. 9 is a side elevational view, partly in cross section, of a drill string with tension having been placed on the upper end of the drill pipe for raising the drill pipe off the bottom of a deviated borehole.

Referring now to FIG. 9, in a still another embodiment of the present invention, a bottom hole assembly 90 is attached to the lower terminal end of CT string 10. Bottom hole assembly 90 includes various components such as a propulsion system 92, a downhole motor 94 and a bit 96. Propulsion systems are disclosed in U.S. Pat. No. 6,296,066, entitled "Well System" and International Publication WO 01/09478 A1 published Feb. 8, 2001, both incorporated herein by reference.

An upward tension force 60 is applied at the surface 11 on the drill string 10, such as by an injector head, while the lower end 21 of the drill string 10 is fixed in the borehole 14 by propulsion system 92, thereby causing the drill string 10 to be raised off the low side 23 of the borehole 14. This upward force at the surface 11 actually lifts the drill string 10 off the bottom 23 of the borehole 14. The borehole retention devices or tractor pads 98 on the propulsion system 92 are actuated to engage the borehole wall, thus anchoring and fixing the lower end of the drill string 10. The upward force on the drill string 10, of course, must not be so great that it breaks the drill pipe. Also, the upward force should not be so great as to cause the propulsion system 92 to lose its grip on the borehole wall.

In operation, the drill string 10 extends deep into the deviated borehole 14. It can be seen that gravity causes the drill string 10 to rest on top of the cuttings bed 20 in the deviated borehole 14. Before upward force 60 is applied, the drill string 10 naturally deviates away from the cuttings bed 20 at the location 52 as the drill string 10 transitions from vertical borehole 18 to deviated borehole 14 in transition portion 54. The object of this embodiment of the present invention is to expose more of the cuttings bed 20 to the flow 40 by lifting the drill string 10 off the bottom of the deviated borehole 14.

When upward force 60 is applied to the drill string 10 from the surface, the drill string 10 is lifted until the wall of the transition portion 54 of the borehole prevents the drill string 10 from moving upward any further. This exposes the cuttings bed 20 underneath the drill string 10 to the flow 40, thereby causing the re-suspended cuttings 38 to be carried to the surface. However, this embodiment is limited by the length of the deviated borehole 14. If the deviated portion of the borehole is too long, the upward force will not lift the entire portion of the drill string in the deviated portion of the borehole off the bottom of the borehole. Only the portion of the cuttings bed 20 between the locations 52 and 58 is exposed. That portion of the drill string 10 capable of being lifted is the portion adjacent the vertical section 18 of the borehole. Thus, the portion of the drill string 10 beyond the location 58 remains in contact with the cuttings bed 20.

Figure 10A:
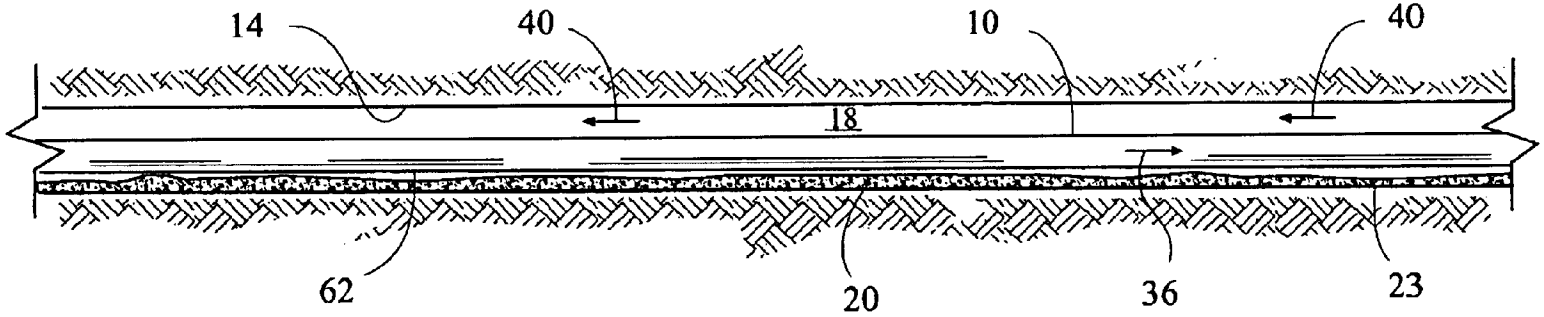
FIG. 10A is a side elevational view, partly in cross section, of a drill string laying on the bottom of a deviated borehole.
Figure 10B:
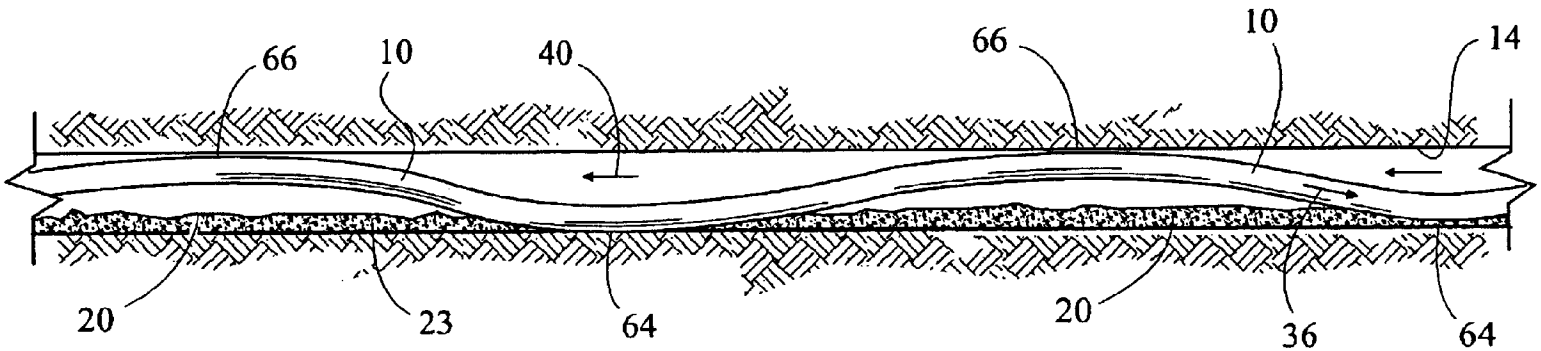
FIG. 10B is a side elevational view, partly in cross section, of a drill string in a helix raising portions of the drill string off the bottom of a deviated borehole.

Referring now to FIGS. 10A and 10B, in still another embodiment, the bottom hole assembly 90 shown in FIG. 9 is attached to the end of drill string 10 shown in FIGS. 10A and B. Upon appropriate command, the down hole propulsion system 92 is moved in a reverse or backward direction. This action by the propulsion system 92 compresses the drill string 10, which then buckles into a helical shape within the deviated borehole 14 as shown in FIG. 10B such that the drill string 10 only touches the bottom 23 of the borehole 14 at the nodes of the helix. FIG. 10B shows the drill string 10 in a sinusoidal condition, although it should be understood that the drill string 10, when it buckles, will be in the form of a corkscrew and not in the form of an undulating wave as is suggested by FIG. 10B. Theoretically, sinusoidal buckling can be achieved, but this will not happen as a practical matter.

FIG. 10B shows the drill string 10 in a helix such that instead of having a substantial continuous contact, such as along surface 24 shown in FIG. 10A between drill string 10 and cuttings beds 20, it can be seen in FIG. 10B that, in helix form, the drill string 10 only engages the bottom 12 of borehole 14 at spaced nodes or points, such as 64. The points 64 correspond with the lowermost nodes of the helix when viewed from the side such as in FIG. 10B. Consequently, much more flow clearance is provided along the bottom 12 of borehole 14 between the nodes 64, thereby allowing the returning fluid flow 40 to entrain cuttings beds 20 and flow the cuttings to the surface.

The technique of backing up the propulsion system 92 allows the removal of the cuttings beds 20 due to the limited contact by the drill string 10 with the bottom 23 of the borehole 14. Movement of the drill string 10, as it buckles and forms a helix, will cause a minimal removal of the cuttings beds 20, although this mechanical action will assist somewhat in re-suspending the cuttings 38. However, it is the goal of this embodiment to remove significant portions of the drill string 10 from the bottom 23 of the borehole 14, and not to depend on the mechanical action of the drill string 10 to remove the cuttings beds 20. It is estimated that approximately ¾ of the drill string 10, in its helical form, would be lifted off the bottom 23 of the borehole 14.

With any single use of the current embodiment, portions of the drill string 10 will not be lifted from the bottom 23 of the borehole 14, such as at the nodal points 64. It is approximated that these unlifted portions can amount to about ¼ of the drill string 10 that is present in the deviated borehole 14. Thus, portions of the cuttings beds 20 remain impeded by the drill string 10 from the flow 40. However, the current embodiment will preferably be used multiple times when the drill string 10 is present in the deviated borehole 14, thereby increasing the likelihood that the impeded portions of cuttings beds 20 will be exposed to the flow 40.

After the helix is formed and cuttings beds are removed, drilling continues, as for example, a couple of hundred feet. After this additional depth of borehole has been drilled, then the propulsion system 92 is again placed in reverse to buckle the drill pipe 10 and form a helix. The probability is that the drill string will not contact the borehole bottom 23 at the same places that it had previously contacted the borehole bottom 23 so that to the extent that cuttings beds 20 have not been washed out in the previous buckling of the drill string, those cuttings beds may now be washed out and swept clean in the subsequent buckling of the drill pipe 10.

Figure 4B:
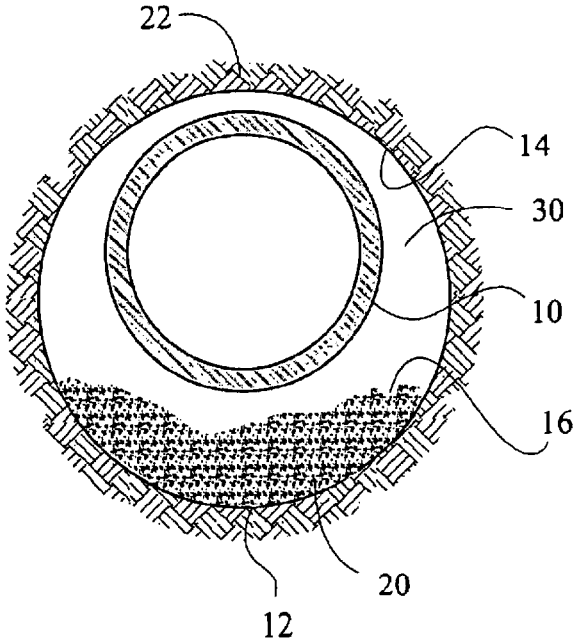
FIG. 4B is a cross section at plane B—B in FIG. 4A.

Referring again to FIGS. 3C and 4A–C, the majority of the velocity profile is located on the high side 22 of the borehole 14. The cuttings bed 20 stays on the bottom 23 of the borehole 14. When the pipe 10 is buckled, the velocity profiles then change. As shown in FIG. 4B, there is shown a portion of the drill pipe 10 which, now due to the buckling and the helical form of the drill string 10, has been moved to the top 22 of the borehole 14. The velocity profile then changes as is shown in FIG. 4C. This velocity profile has shifted from the upper portion 18 of the borehole 14 to the lower portion of the borehole 14 thereby allowing the returning fluids to wash out and remove the cuttings beds 20 which previously had been settling on the bottom 23 of the borehole 14. With the fluid velocities shifted to the lower side of the borehole 10, the cuttings can now be removed.

Figures 11A, 11B:
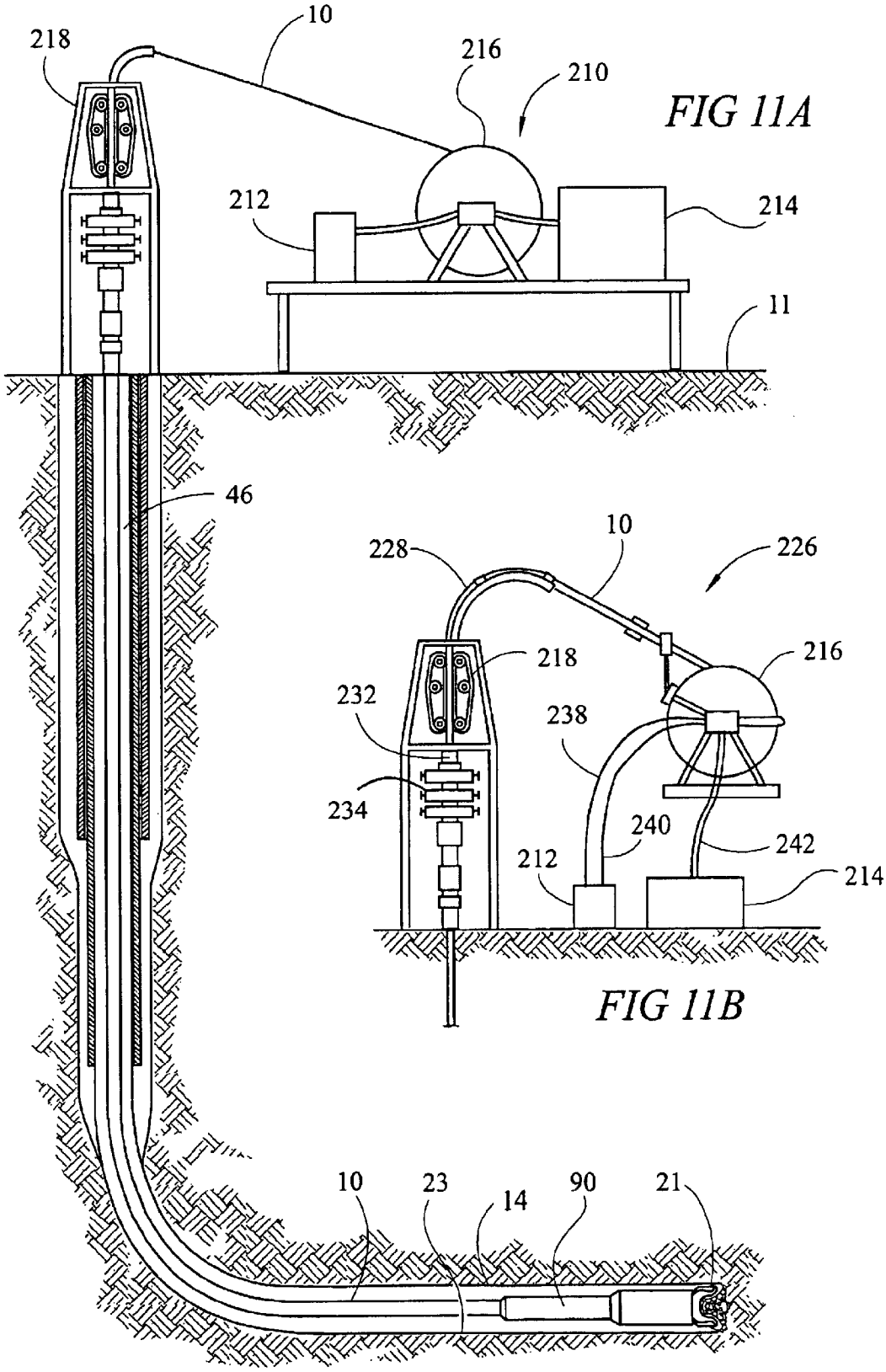
FIG. 11A is a side elevational view, partly in cross section, of a drill string with drilling fluid pumps for pulsing the fluids in the drill pipe to raise the drill pipe off the bottom of a deviated borehole.
FIG. 11B is an enlarged schematic view of the coiled tubing system used with the pumps shown in FIG. 11A.

Referring now to FIGS. 11A and 11B, still another embodiment includes pulsing the drilling fluid pumps. FIG. 11A shows an exemplary operating environment for this embodiment of the present invention. Coiled tubing operation system 210 includes a power supply and processor 212, one or more pumps 214, and a coiled tubing spool 216. An injector head unit 218 feeds and directs coiled tubing 10 from the spool 216 into the wellbore 46. Although the coiled tubing 10 is preferably composite coiled tubing as hereinafter described, it should be appreciated that the present invention is not limited to composite coiled tubing and may be steel coiled tubing. A bottom hole assembly 90 is shown attached to the lower end of composite coiled tubing 10 and extending into a deviated or horizontal borehole 14.

FIG. 11B illustrates coiled tubing unit 226 utilizing spool 216 for feeding composite tubing 10 over guide 228 and through injector 218 and stripper 232. The composite coiled tubing 10 is forced through blowout preventer 234 and into well 46 by injector 218. Power supply and surface processor 212 are connected by conduits 238, 240 to electrical conduits and data transmission conduits in the wall of composite coiled tubing 10. Conduits 238, 240 housed within the composite tubing wall extend along the entire length of composite coiled tubing 10 and are connected to bottom hole assembly 90. Pumps 214 are connected by conduit 242 to the upper end of composite coiled tubing 10. The lower end of composite coiled tubing 10 is connected to the bottom hole assembly 90.

The entire length of the CCT 10 shakes upon pulsing the pumps 214. This embodiment, theoretically, may be used with MCT, but is not intended for such. The concept is similar to the hydraulic oscillator described hereinabove, except the pulsing pump 214 is more effective. It is contemplated that large dynamic pressures can be induced along the entire length of the drill string 10, thereby shifting the entire drill string 10 so as to agitate the cuttings for removal.

As the pump pressures up the flowbore of the CCT 10, the drill string 10 expands radially and becomes shorter in length. Upon reducing the pressure, the CCT drill string 10 radially contracts and returns to its original length. By pressuring up and then reducing pressure, the CCT length is shortened and lengthened repeatedly. As it contracts and elongates, there is movement between the drill string 10 and the bottom 23 of the borehole 14 so as to agitate the cuttings. The amount of lengthening and contraction may be a couple of feet depending upon the over all length of the CCT drill string 10. This methodology does not lift the pipe but merely shifts the pipe along the bottom 23 of the borehole 14, thereby agitating the cuttings. The surface processor 212 controls the drilling fluid pump 214 at the surface 11.

In a variation to the previous embodiment, the processor control system 212 also allows the introduction of air into the drilling fluid passing through the drill string 10. Also, a type of pressure pulse may be induced into the drilling fluid such as the pulse introduced for mud pulse telemetry used by Sperry Rand. See U.S. patent application Ser. No. 09/783,158, filed Feb. 14, 2001 and entitled Downlink Telemetry System.

Mud pulse telemetry induces flow pressure mud pulses. In mud pulse telemetry, part of the fluid flowing down hole is bypassed at the surface 11. The bypass is open for a few seconds and then it is closed. A motorized valve at the surface is actuated at set periods to shunt fluid flow into a bypass. It could be an oscillating flow. This system induces a heavy pressure pulse in the drilling fluid. Alternatively, any motorized valve at the surface with a bypass could be used. The mud pulses for this system would be much higher than that for telemetry. The high mud pulses would be as high as the drill string 10 could withstand, such as in the range of 1,000 to 3,000 psi, with the highest pressures being preferable. Operating limits will exist due to the design of the pipe 10. The period for the high pressure pulse will also depend upon the length of the drill string 10. A motorized ball valve is included at the surface having a bypass port back to the mud pit. The motorized valve is set up so that it allows full flow for a certain period, and then a diversion of flow through the bypass for a certain period. Ideally, the goal is to achieve the highest pressure possible over the shortest period of time. The time period must allow the string 10 time to react to the pressure pulse, i.e., time to expand and contract due to the pulse. The string 10 will not react quickly, so therefore there is a finite minimum period required to get the string 10 to expand and contract. A predetermined time period for full flow and a time period for shunted flow is provided for each well.

The use of high pressure mud pulses is preferably used in combination with a helically buckled drill string. This allows the string 10 to scrub the bottom 23 of the borehole 14 and achieve the maximum cleaning effect.

Although the different solutions and embodiments are directed to the use of composite coiled tubing, many of them may also be used with metal coiled tubing. For example, flotation collars may be used with MCT. Also, deflectors may be disposed at spaced intervals on MCT. For example, centralizers may be placed on MCT. Also, the backing up of the propulsion system to buckle the coiled tubing may be used with MCT. Further, the density differential using different density sweeps in the flowbore and the annulus may also be applied to MCT.

It should be appreciated that all of these solutions and embodiments may be used together or in different combinations.

It also should be appreciated that these solutions and embodiments can be used in a mixed drill string, i.e., a drill string whose lower portion is composite coiled tubing and its upper portion is metal coiled tubing, as for example. The CCT would be used to extend through that portion of the highly deviated borehole where the removal of cuttings beds is a problem. That portion of the drill string extending through the less highly deviated borehole, which is more vertical, would be MCT. There would be a connector for connecting the metal coiled tubing to the composite coiled tubing. This could be called a hybrid drill string.

Another variation is to use MCT with a composite layer around its outer surface to achieve buoyancy. This particular type of MCT may be termed "semi-composite" coiled tubing. The advantages of achieving buoyancy in the deviated borehole 14 can be achieved by attaching a lighter material around the MCT. Such lighter materials include material typically used to manufacture CCT, including fiberglass and carbon fiber. Conceptually, this variation is similar to the embodiment in which both materials and dimensions were varied. However, this variation seeks to use both CCT and MCT, instead of varying the material composition of one or the other. It is preferable to use a small diameter inner steel or metal pipe when surrounding the MCT with a non-metallic material. However, increasing the outer diameter, while adding a less dense material, will decrease the average density of the semi-composite coiled tubing. Thus, an optimal increased diameter does exist.

For example, Styrofoam may be wrapped around the MCT, causing it to float. When displacing a greater amount of fluid by adding a lighter density material, buoyancy is created. In one embodiment of the semi-composite CT variation, a titanium drill string is wrapped in a non-metallic material to provide flotation. Titanium is both strong and light. The low density material wrapped around the outside of the titanium drill string reduces the over all density and increases displacement of the drilling fluid. It should be noted that, as the wellbore depth, and therefore pressure, increase, the strength of the low density material must increase to resist undesirable deformation or collapse.

It should also be noted that increasing the diameter of the drill string 10 in the deviated borehole section 14 causes the velocity of the fluid in the annulus 30 to increase for a given flow rate of the drilling fluid, thereby improving hole cleaning. Several ways of making the drill string less dense included increasing the CT's outer diameter. Increasing the outer diameter decreases the size of the annulus 30 and the useable annular flow area. This increases the velocity of the fluid for a given flow rate through the annulus 30. This feature is known in the prior art but may be used in combination with one or more of the above solutions or embodiments. Increasing the pipe diameter provides the secondary benefit of increasing the annulus velocity.

A circulation port allowing flow directly from the flowbore of the drill string 10 and into the annulus 30 to increase fluid flow in the annulus 30 may be used in combination with any of the above solutions or embodiments. Although it is preferred that the circulating sub not be used while drilling, any of the solutions or embodiments which can be performed while not drilling are viable options to be used in combination with the circulation sub. The practical problem is that if there is a bypass of fluid above the motor, there may be insufficient fluid passing through the motor to adequately rotate the bit. It is possible to jet the circulation sub so as to bypass a significant amount of fluid and still drill. Ultimately, there are two limitations: (1) only a finite volume of fluid can be pumped down the drill string and (2) the jets tend to erode or curve the borehole wall. Deflectors may be used on the nozzles of the jet circulation subs to prevent the nozzles from directing fluid directly against the borehole wall. There is also concern over turbulence in certain formations. The erosion of the borehole is largely a function of the type formation making up the borehole wall. If the formations are soft, the turbulent flow will also cause erosion. If the borehole wall is granite, there will be no erosion. Another practical erosion problem is actual erosion caused in the circulation sub. This erosion occurs internally in the sub due to the abrasive nature of the drilling fluid and its contents.

The present invention provides many advantages over the prior art. First, having the ability to float the drill pipe in a deviated portion of a well bore allows the operator to design new well plans and drill plans because of this added advantage. The chief advantage is efficient cleaning of the borehole. Cleaning the borehole allows the operator to drill a longer interval and a deeper well. The drill pipe can stay in the hole longer and the drilling is more efficient. Although floating the pipe may be preferred, any means for raising and positioning the pipe on the high side of a deviated or horizontal borehole permits these advantages.

Further, the present invention has the advantage of making possible the drilling of greater lengths of borehole before various conventional methods of cleaning the cuttings out of the borehole may then be deployed. Other advantages include the reduction in the time associated with drilling using coiled tubing. Further, the present invention reduces the cost associated with drilling using coiled tubing. The present invention also allows the length of the well which can be drilled with coiled tubing to be extended. The present invention also improves the economics of drilling with coiled tubing as compared with conventional methods.

While a preferred embodiment of the invention has been shown and described, modifications thereof can be made by one skilled in the art without departing from the spirit of the invention.

What is claimed is:

1. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling;

means for raising at least a portion of said pipe string in the deviated borehole to remove cuttings from underneath said pipe string portion; and wherein said pipe string portion is disposed in the deviated borehole significantly uphole of the bottom hole assembly.

2. The apparatus of claim 1 wherein said raising means includes using a composition for said pipe string which causes said pipe string to be buoyant in the drilling fluids.

3. The apparatus of claim 1 wherein said pipe string has a wall with an outer diameter and a thickness, said raising means including increasing said outer diameter and thickness of said pipe string wall to cause said pipe string to become less dense and therefore be buoyant in the drilling fluids.

4. The apparatus of claim 3 wherein said raising means further includes using a composition for said pipe string which causes said pipe string to be buoyant in the drilling fluids.

5. The apparatus of claim 1 wherein said raising means includes attaching a buoyant material to said pipe string which causes said pipe string to be buoyant in the drilling fluids.

6. The apparatus of claim 1 wherein said raising means includes fluid deflectors attached to said pipe string deflecting the drilling fluids beneath said pipe string causing said pipe string to rise within the borehole.

7. The apparatus of claim 1 wherein said raising means includes mechanical deflectors attached to said pipe string deflecting said pipe string away from a bottom of the borehole.

8. The apparatus of claim 1 wherein said raising means includes a centralizer around said pipe string raising said pipe string away from a bottom of the borehole.

9. The apparatus of claim 1 wherein said raising means includes an eccentric stabilizer disposed in said pipe string.

10. The apparatus of claim 1 wherein said raising means includes a less dense drilling fluid in said pipe string and a more dense drilling fluid around said pipe string.

11. The apparatus of claim 1 wherein said bottom hole assembly includes a propulsion system, said raising means including placing said propulsion system in reverse to cause said pipe string to helix and raise said portion of said pipe string.

12. The apparatus of claim 1 further including a tensioner wherein said bottom hole assembly includes a propulsion system, said raising means includes fixing one end of said pipe string and placing tension on another end of said pipe string using said tensioner to cause a portion of said pipe string to raise off a bottom of the borehole.

13. The apparatus of claim 1 further including a pump to pump the drilling fluids, said raising means including pulsing said pump to cause said pipe string to raise within the borehole.

14. The apparatus of claim 13 wherein said raising means further includes introducing air into the drilling fluids.

15. The apparatus of claim 1 further including a valve for the drilling fluids, said raising means including diverting a portion of the drilling fluids through said valve to cause said pipe string to raise within the borehole.

16. The apparatus of claim 1 wherein said pipe string has one portion made of metal and another portion made of a composite.

17. The apparatus of claim 1 wherein said pipe string includes an inner metal tube and an outer composite around said inner metal tube.

18. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling; and wherein at least a portion of said pipe string comprises a composition which causes said pipe string portion to be buoyant in the drilling fluids.

19. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling; and wherein said pipe string has a wall with an outer diameter and a thickness, and wherein at least a portion of said pipe string has an increased outer diameter and thickness which causes said pipe string portion to become less dense and therefore be buoyant in the drilling fluids.

20. The apparatus of claim 19 wherein said pipe string portion comprises a composition which causes said pipe string to be buoyant in the drilling fluids.

21. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling; and a buoyant material attached to at least a portion of said pipe string which causes said pipe string to be buoyant in the drilling fluids.

22. The apparatus of claim 21 wherein said buoyant material includes at least one collar of a buoyant material.

23. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling; and at least one fluid deflector attached to said pipe string, said fluid deflector deflecting the drilling fluids beneath said pipe string causing said pipe string to raise within the borehole.

24. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling;

at least one mechanical deflector attached to said pipe string, said mechanical deflector deflecting said pipe string away from a bottom of the borehole; and wherein said pipe string portion is disposed in the deviated borehole significantly uphole of the bottom hole assembly.

25. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling;

at least one centralizer attached around said pipe string, said centralizer raising said pipe string away from a bottom of the borehole to allow fluid flow underneath said pipe string; and wherein said pipe string portion is disposed in the deviated borehole significantly uphole of the bottom hole assembly.

26. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling;

at least one eccentric stabilizer disposed in said pipe string, said eccentric stabilizer raising said pipe string away from a bottom of the borehole to allow fluid flow beneath said pipe string; and wherein said pipe string portion is disposed in the deviated borehole significantly uphole of the bottom hole assembly.

27. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling; and wherein a less dense drilling fluid is in said pipe string and a more dense drilling fluid is around said pipe string causing at least a portion of said pipe string to be buoyant in the drilling fluids.

28. An apparatus for removing cuttings in a deviated borehole using drilling fluids, the apparatus comprising:

a pipe string;

a tensioner;

a bottom hole assembly having:

a down hole motor;

a bit for drilling the borehole; and a propulsion system;

said pipe string having one end attached to said bottom hole assembly;

said pipe string being non-rotating during drilling; and wherein one end of said pipe string is fixed and tension is placed on another end of said pipe string using said tensioner to cause at least a portion of said pipe string to raise off a bottom of the borehole.

29. An apparatus for removing cuttings in a deviated borehole using drilling fluids, the apparatus comprising:

a pipe string;

a bottom hole assembly having:

a down hole motor;

a bit for drilling the borehole; and a propulsion system;

said pipe string having one end attached to said bottom hole assembly;

said pipe string being non-rotating during drilling; and wherein said propulsion system is placed in reverse to cause said pipe string to helix and raise at least a portion of said pipe siring away from a bottom of the borehole.

30. An apparatus for removing cuttings in a deviated borehole using drilling fluids, the apparatus comprising:

a pipe string;

a bottom hole assembly having a down hole motor and bit for drilling the borehole;

a pump to pump the drilling fluids;

said pipe string having one end attached to said bottom hole assembly;

said pipe string being non-rotating during drilling; and wherein said pump is pulsed to cause at least a portion of said pipe string to raise within the borehole.

31. An apparatus for removing cuttings in a deviated borehole using drilling fluids, the apparatus comprising:

a pipe string;

a valve for the drilling fluids;

a bottom hole assembly having a down hole motor and bit for drilling the borehole;

said pipe string having one end attached to said bottom hole assembly;

said pipe string being non-rotating during drilling; and wherein said valve selectably diverts a portion of the drilling fluids to cause at least a portion of said pipe string to raise within the borehole to allow fluid flow beneath said portion.

32. An apparatus for removing cuttings in a deviated borehole using drilling fluids, the apparatus comprising:

a pipe string;

a bottom hole assembly having a down hole motor and bit for drilling the borehole;

said pipe string having one end attached to said bottom hole assembly;

said pipe string being non-rotating during drilling; and wherein at least a portion of said pipe string comprises an inner metal tube and an outer, less dense composite around said inner metal tube which causes said pipe string portion to be buoyant in the drilling fluids.

* * * * *